US009490582B2

(12) United States Patent
Jaschke et al.

(10) Patent No.: US 9,490,582 B2
(45) Date of Patent: Nov. 8, 2016

(54) INSULATION BODY OF A PLUG-IN CONNECTOR

(71) Applicant: Harting Electronics GmbH, Espelkamp (DE)

(72) Inventors: Stefan Jaschke, Bad Essen (DE); Melanie Genau, Luebbecke (DE)

(73) Assignee: HARTING ELECTRONICS GMBH, Espelkamp (DE)

( * ) Notice: Subject to any disclaimer, the term of this patent is extended or adjusted under 35 U.S.C. 154(b) by 88 days.

(21) Appl. No.: 14/397,322

(22) PCT Filed: Apr. 24, 2013

(86) PCT No.: PCT/DE2013/100151
§ 371 (c)(1),
(2) Date: Oct. 27, 2014

(87) PCT Pub. No.: WO2013/159773
PCT Pub. Date: Oct. 31, 2013

(65) Prior Publication Data

US 2015/0093935 A1 Apr. 2, 2015

(51) Int. Cl.

| | |
|---|---|
| ***H01R 13/58*** | (2006.01) |
| ***H01R 13/648*** | (2006.01) |
| ***H01R 4/24*** | (2006.01) |
| ***H01R 13/6585*** | (2011.01) |
| ***H01R 13/502*** | (2006.01) |

(Continued)

(52) U.S. Cl.
CPC ..... *H01R 13/648* (2013.01); *H01R 4/2433* (2013.01); *H01R 4/42* (2013.01); *H01R 9/03* (2013.01); *H01R 13/502* (2013.01); *H01R 13/6585* (2013.01); *H01R 13/5833* (2013.01)

(58) Field of Classification Search
CPC ..... H01R 13/58; H01R 13/4223
USPC ..... 439/460, 469, 470, 472, 595, 598, 587
See application file for complete search history.

(56) References Cited

U.S. PATENT DOCUMENTS

| | | | | |
|---|---|---|---|---|
| 4,501,463 | A | 2/1985 | Stebegg et al. | |
| 4,737,122 | A * | 4/1988 | Dechelette | H01R 24/60 439/418 |

(Continued)

FOREIGN PATENT DOCUMENTS

| | | |
|---|---|---|
| DE | 4418259 | 8/1995 |
| DE | 19836631 | 3/2000 |

(Continued)

*Primary Examiner* — Phuongchi T Nguyen
(74) *Attorney, Agent, or Firm* — Jacobson Holman, PLLC

(57) ABSTRACT

The invention relates to an insulation body that can be inserted into a housing (11) of a plug-in connector (10), which is formed from a connecting portion (2) and a contacting portion (3), wherein in the contacting portion (3), contacting means (4) are provided and the connecting portion (2) is provided with recesses (5), in which individual conductors of a multi-core cable can be clamped, wherein the connecting portion (2) and the contacting portion (3) can be joined together, so that the individual conductors of the multi-core cable can be electrically contacted by means of the individual contacting means (4). According to the invention, the connecting portion (2) includes means that orientate the individual conductors along the recesses (5) of the connecting portion (2) in such a way that each of the conductors is pushed into the respective recesses and the direction of the conductor changes along the recesses.

8 Claims, 2 Drawing Sheets

(51) Int. Cl.
*H01R 4/42* (2006.01)
*H01R 9/03* (2006.01)

(56) References Cited

U.S. PATENT DOCUMENTS

| | | | | |
|---|---|---|---|---|
| 5,277,616 | A | 1/1994 | Harting et al. | |
| 5,755,589 | A | 5/1998 | Koch | |
| 6,244,893 | B1 | 6/2001 | Dudley et al. | |
| 6,409,544 | B1 * | 6/2002 | Wu | H01R 24/64 439/418 |
| 6,811,445 | B2 * | 11/2004 | Caveney | H01R 13/514 439/676 |

FOREIGN PATENT DOCUMENTS

| | | |
|---|---|---|
| DE | 19952044 | 5/2000 |
| DE | 102011000460 | 8/2012 |
| EP | 0083738 | 7/1983 |
| EP | 0554810 | 8/1983 |
| EP | 0684666 | 11/1995 |
| EP | 1311022 | 5/2003 |
| FR | 2921522 | 3/2009 |
| WO | WO 2004/105186 | 12/2004 |

* cited by examiner

Characters

INSULATION BODY OF A PLUG-IN CONNECTOR

An insulation body of a plug-in connector that comprises a connecting portion and a contacting portion that can be plugged together to receive individual conductors of a multi-core cable.

BACKGROUND OF THE INVENTION

Such insulation bodies are needed in order to provide multipin plug-in connectors for analogue or digital data transmission, which can be used in shielded implementations at frequencies of up to 600 MHz or even higher.

In connectors of this kind, the electrical conductors are usually electrically contacted via terminal clamps. One way of contacting electrical conductors simply via termination clamps is known for example from DE102011000460A1.

DE 198 36 631 A1 shows an insulation body of a plug-in connector which is formed from a connecting portion and a contacting portion. Within the connecting portion, individual conductors of a multi-core cable may be inserted, which individual contactors extend in an S shape within the connecting portion. The contacting portion is equipped with termination clamps that electrically contact the individual conductors when the connecting portion and the contacting portion are joined together.

EP554810B1 shows a two-piece insulation body, wherein one piece comprises bores into which the individual conductors of a cable to be connected can be inserted. The other piece comprises termination clamps. As the two pieces are joined together, the individual conductors of the cable are pushed into the termination clamps and are as a result electrically contacted.

The bores in the insulation body do not exclusively extend in an axial direction, but they also have a radial component in at least one area. However, the insertion of the electrical conductors into the individual bores is frequently difficult and time consuming.

SUMMARY OF THE INVENTION

It is an object of the invention to provide for a simple assembly of electrical conductors.

Insulation bodies according to the invention carry as a rule the contact elements (contact pins, sockets), which later form the plug-in face of the plug-in connector. The insulation bodies are inserted into a matching housing of a plug-in connector. The housings may be made from a metallic material, but may also be made from plastics.

Advantageously, the insulation body is formed to be substantially cylindrical. This is in particular the case with circular plug-in connectors. Its cylindrical insulation body has an axis of symmetry which in the language used here describes the axial direction or axial orientation. The radial direction is described via a direction vector that is oriented perpendicularly to the axis of symmetry in the direction of the lateral surface of the insulation body.

The insulation body is made up of a connecting portion and a contacting portion. In the contacting portion, contacting means, preferably termination clamps, are provided, via which individual conductors of a multi-core cable can be contacted. Preferably, the contact elements are also located in the contacting portion.

In an advantageous embodiment of the invention, the contacting portion also includes a shielding element that shields the contacted conductors electromagnetically from each other at least in a pair-wise manner.

The connecting portion is provided with recesses, in which the individual conductors of the cable to be connected can be clamped. This is preferably realised via so-called clamping ribs, which are provided in the individual recesses arranged opposite each other in an offset manner.

According to the invention, the connecting portion includes means which orientate the individual conductors at the same time axially and radially along the recesses of the connecting portion at least in one area.

Preferably, the connecting portion is formed in two pieces. It consists of a clamping portion and a positioning sleeve that can be pushed onto the latter. The recesses described above are then arranged in an axial direction along the lateral surface of the substantially cylindrical clamping portion.

The positioning sleeve is pushed over the clamping portion so that the conductors clamped in the recesses are pushed in a radial direction at least in one area. This is preferably realised via radially inwardly directed webs of the positioning sleeve.

The connecting portion and the contacting portion can be joined together. As a result of the joining together of the two portions, the individual conductors of the multi-core cable are electrically contacted by the individual contacting means.

The essence of the invention relates to an insulation body that can be inserted into a housing of a plug-in connector that is formed from a connecting portion and a contacting portion, wherein in the contacting portion, contacting means are provided, and the connecting portion is provided with recesses in which individual conductors of a multi-core cable can be clamped, wherein the connecting portion and the contacting portion can be plugged together, so that the individual conductors of the multi-core cable can be electrically contacted by the individual contacting means. According to the invention, the connecting portion includes means which orientate the individual conductors along the recesses of the connection porting in such a way that each of the conductors is pushed into the respective recesses and the direction of the conductor changes along the recesses.

One possible embodiment example of the invention is represented in the drawings and will be explained in more detail below.

DETAILED DESCRIPTION OF THE INVENTION

Figure 1:
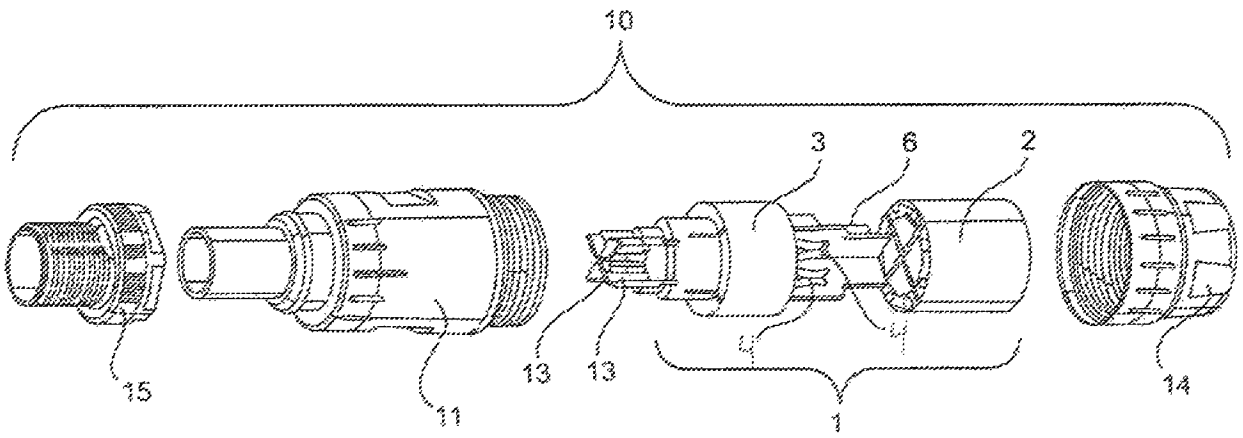
FIG. 1 shows a perspective exploded view of a plug-in connector.
Figure 2:
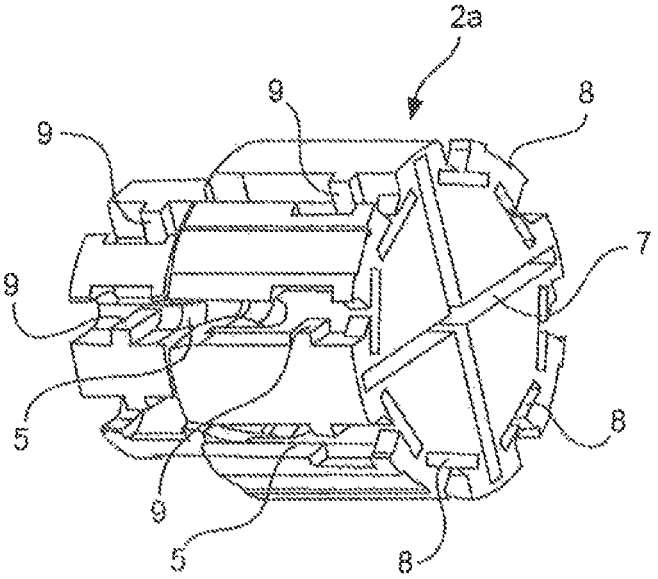
FIG. 2 shows a perspective view of a clamping portion.
Figure 3:
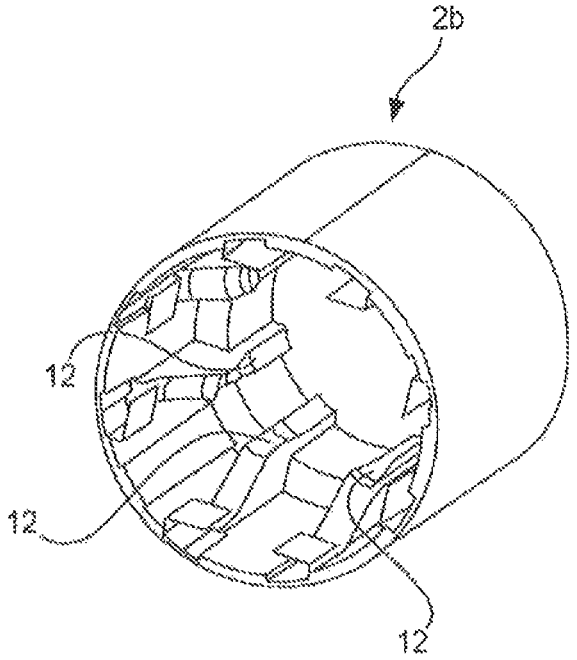
FIG. 3 shows a perspective view of a positioning sleeve.

FIG. 1 shows a perspective exploded view of a plug-in connector 10. The plug-in connector 10 has a substantially cylindrical shape and is also referred to by a person skilled in the art as a circular plug-in connector.

The insulation body 1 consists of a contacting portion 3, in which termination clamps 4, contact elements 13 and a shielding cross 6 are provided. In addition, the insulation body 1 is composed of a connecting portion 2, along the lateral surface of which recesses 5 are provided in which individual conductors of a multi-core cable can be clamped.

The clamping function is realised via the clamping ribs 9 provided in the recesses 5. The connecting portion 2 is surrounded by a cylindrical positioning sleeve 2*b*.

The positioning sleeve 2*b* has radially inwardly directed webs 12. The webs 12 are substantially wedge-shaped and force the individual conductors within the insulation body onto an S-shaped path. The webs 12 cause the conductors clamped in the recesses 5 to be pushed radially downwards, if viewed in an axial direction, to different extents. The conductors extend in the connecting portion 2 in an S shape at least in one area.

As the connecting portion 2 and the contacting portion 3 are joined together, the shielding cross 6 is inserted into a cruciform axial opening 7 provided for this purpose. At the same time, the termination clamps 4 are inserted into axial openings 8, which are provided in a circular manner on the front side of the clamping portion 2*a*. The forked area of the termination clamps penetrates the insulation of the individual conductors and thus comes into electrical contact with the latter.

The insulation body 1 is pushed into the cavity of the housing 11. The housing 11 is sealed via a screw head 14. The force necessary for joining the two insulation body portions 2, 3 together can also be exerted via the screw head 14. In this case, the insulation body portions 2, 3 are initially preliminarily joined together over the shielding cross, and at this point, the conductors have not yet been pushed into the forked area of the termination clamps 4. As the screw head 14 is screwed onto the housing 11, the conductors are pushed into the termination clamps 4 and as a result come into electrical contact with the latter.

The other end of the housing 11 is provided with a connection head 15. The connection head 15 can be used to connect the plug-in connector 10 to a device or a counter-connector. For the connection, the connection head 15 is provided with an external thread.

LIST OF REFERENCE NUMERALS

1 Insulation body
2 Connecting portion
  2*a* Clamping portion
  2*b* Positioning sleeve
3 Contac ting portion
4 Contacting means
5 Recesses
6 Shielding element
7 First axial opening
8 Second axial opening
9 Clamping ribs
10 Plug-in connectors
11 Housing
12 Web
13 Contact element
14 Screw head
15 Connection head

The invention claimed is:

1. An insulation body insertable into a housing of a plug-in connector and defining an axial direction from a first end to a second end and defining a radial direction oriented perpendicular to the axial direction, said insulation body comprising a contacting portion (3) and a connecting portion (2) which can be plugged together, said contacting portion including contact elements (4) for making electrical contact with individual conductors of a multi-core cable, said connecting portion including a clamping portion (2*a*) and a positioning sleeve (2*b*) disposed around said clamping portion, said clamping portion including axially and radially extending recesses (5) for receiving individual conductors of a multi-core cable, said positioning sleeve (2*b*) including radially inwardly directed elements for pushing the individual conductors in a radial direction to clamp the individual conductors within the recesses such that the individual conductors can change directions to conform to the axial and radial orientation of the recesses when the positioning sleeve (2*b*) is disposed around the clamping portion (2*a*), wherein individual conductors within recesses of the connecting portion are engageable with the contact elements of the contacting portion when the contacting portion and connecting portion are plugged together.

2. The insulation body as claimed in claim 1, characterised in that the positioning sleeve (2*b*) includes wedge-shaped webs (12) which force the individual conductors into an S-shaped path.

3. The insulation body as claimed in claim 1, characterised in that the contacting means (4) are termination clamps.

4. The insulation body as claimed in claim 1, characterised in that the connecting portion (2) comprises clamping ribs (9) through which individual conductors of the multi-core cable can be clamped in the recesses (5).

5. The insulation body as claimed in claim 1, characterised in that the insulation body (1) is substantially cylindrical.

6. The insulation body as claimed in claim 1, characterised in that the contacting portion (3) includes a shielding element (6) that electromagnetically shields the electrically contacted conductors at least in a pairwise manner.

7. The insulation body as claimed in claim 6, characterised in that the connecting portion (2) includes at least one first axial opening (7) into which the shielding element (6) can be inserted.

8. The insulation body as claimed in claim 7, characterised in that the connecting portion (2) includes at least one axial opening (8) into which a contact element (4) can be inserted.

* * * * *